US007695348B2

(12) United States Patent
Mase

(10) Patent No.: US 7,695,348 B2
(45) Date of Patent: Apr. 13, 2010

(54) ABRASIVE-RECOVERY MECHANISM IN BLASTING MACHINE

(75) Inventor: Keiji Mase, Tokyo (JP)

(73) Assignee: Fuji Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 12/238,868

(22) Filed: Sep. 26, 2008

(65) Prior Publication Data

US 2009/0098810 A1 Apr. 16, 2009

(30) Foreign Application Priority Data

Oct. 12, 2007 (JP) ..... 2007-266590

(51) Int. Cl.
*B24C 9/00* (2006.01)

(52) U.S. Cl. ..... 451/87; 451/88

(58) Field of Classification Search ..... 451/75, 451/87, 88, 89

See application file for complete search history.

(56) References Cited

U.S. PATENT DOCUMENTS 3,672,292 A * 6/1972 Arnold ..... 454/49
4,325,292 A * 4/1982 McNinney et al. ..... 451/453
4,723,378 A * 2/1988 VanKuiken et al. ..... 451/87
5,018,319 A * 5/1991 Allard ..... 451/87
5,481,832 A * 1/1996 Tirikos ..... 451/75
5,571,043 A * 11/1996 Lyras et al. ..... 451/87
6,361,416 B1 * 3/2002 Hopkins et al. ..... 451/88
7,070,489 B2 * 7/2006 Rogmark ..... 451/88
2001/0055943 A1 * 12/2001 Voutilainen ..... 451/87

FOREIGN PATENT DOCUMENTS

JP 2005074563 A 3/2005

* cited by examiner

*Primary Examiner*—Eileen P. Morgan
(74) *Attorney, Agent, or Firm*—Porzio Bromberg & Newman, P.C.

(57) ABSTRACT

A bottom wall surface of a blasting chamber of a blasting machine provided with hoppers for recovering an abrasive is formed at a lowest possible position. A cabinet 3 of a blasting machine 1 is compartmentalized at a predetermined position into an upper space and a lower space by mesh members (21, 22) that allow the abrasive to pass therethrough to form a blasting chamber 2 having a bottom wall surface 20 defined by the mesh members (21, 22). Hoppers 10 substantially shaped like an inverted quadrangular pyramid are disposed below the mesh members (21, 22) such that top portions of the hoppers 10 are opened toward the mesh members (21, 22) and that the bottom end of each of the hoppers 10 is made to communicate with suction means, such as a dust collector, through a recovery pipe 30.

10 Claims, 16 Drawing Sheets

ABRASIVE-RECOVERY MECHANISM IN BLASTING MACHINE

CROSS REFERENCE TO RELATED APPLICATION

This application claims priority on JP 2007-266590, filed Oct. 12, 2007, hereby incorporated in its entirety by reference into this application.

BACKGROUND OF THE INVENTION

1. Field of the Invention

The present invention relates to an abrasive-recovery mechanism in a blasting machine and, more particularly, to an abrasive-recovery mechanism for recovering an abrasive ejected mainly in a blasting chamber formed in a cabinet of a blasting machine.

The blasting machine according to the present invention encompasses various types of blasting machines such as a sand-blasting machine for dry-ejecting or dry-projecting (hereinafter, referred to as "ejecting", including projecting) a mixed fluid composed of a compressed gas, such as compressed air, and an abrasive; and a suction blasting machine or a direct-pressure blasting machine for use in a shot peening machine. The blasting machine according to the present invention also includes those machines for ejecting an abrasive by centrifugal force and those for ejecting an abrasive by bombarding with the use oft for example, a rotating impeller.

The abrasive to be recovered by the recovery mechanism according to the present invention includes not only the abrasive used for polishing or cutting, such as abrasive grains, but also so-called "shot" (e.g., steel balls, glass beads, plastic beads, and ceramic beads) ejected in order to endow objects to be processed or products to be treated (hereinafter, referred to as "workpieces" comprehensively) with residual stress or for the purpose of surface treatment such as coating, and further includes powders or particles to be ejected for various other purposes. In addition, the abrasive to be recovered by the recovery mechanism according to the present invention includes dust, such as powders of workpieces by bombarding and a crushed abrasive particle, generated by ejecting the abrasive, as well as a reusable abrasive.

It should be noted, however, that the following descriptions of embodiments focus on the process of recovering the abrasive. The above-described dust is transported via the same recovery route as the abrasive until it is separated from the abrasive in a dust collector.

When classified according to raw material, the above-described abrasive is made of ceramic, glass, metal, resin, or plant matter. A ceramic-based abrasive includes alundum, carborundum, garnet, zircon beads, zircon shot, zircon grit, and so forth. A glass-based abrasive includes glass beads. A metal-based abrasive includes steel shot, steel grit, steel beads, round-cut wires, stainless-steel shot, stainless-steel beads, stainless-steel cut wires, and so forth, when classified according to material and shape. A resin-based abrasive includes nylon, polycarbonate, Polyplus™, and so forth, when classified according to material. A plant-based abrasive include walnuts (walnut shells), apricots (apricot seeds), peaches (peach seeds), and so forth. As far as shape is concerned, the abrasive may be polygonal, grid-shaped, spherical, bead-shaped, cylindrical, shaped like cut wire, and so forth.

The above-described abrasive is used for the purposes of superficial delamination such as mold cleaning, coating delamination, nitriding; cleaning such as derusting and dirt removal; surface treatment such as carving, patterning, and plating; shot peening for satin-like finishing or metal finishing; and deburring of machined products, resin-molded products, or diecast products.

As far as grain size is concerned, the above-described abrasive is available in a wide variety of specifications including #30 to #280 (0.3 mm to 2.8 mm in diameter) for the metal-based abrasive with large diameters; and #20 to #220 (1000 to 53 μm), fine particle, and #240 to #8000 (57 to 1.2 μm) for the ceramic-based abrasive.

2. Description of the Related Art

As described above, the abrasive is ejected onto a workpiece to cut or clean the workpiece by sand-blasting, or shot, such as steel balls, is made to bombard on a workpiece to coat the workpiece with tin, zinc, and other metals or to endow the workpiece surface with residual stress by shot peening processing.

During the process of ejecting powders or particles onto a workpiece in this manner, the working environment is contaminated by any dispersion of the reusable abrasive that has been recovered after being ejected, the crushed abrasive particle as a result of the abrasive bombarding on the workpiece, or dust such as a cut particle of the workpiece. In order to reuse the abrasive that has been used once, it is necessary to recover the abrasive. For this reason, a blasting machine includes a cabinet in the form of a box where the abrasive is ejected and processed, and the abrasive is ejected on a workpiece in a blasting chamber formed in this cabinet to prevent the abrasive or dust from dispersing outside the cabinet.

Referring to FIG. 10, a hopper 10' forms a lower part of a cabinet 3 and is shaped like an inverted pyramid tapering downward so that the abrasive, dust, and so forth in a blasting chamber 2 can be recovered. The bottom end of this hopper 10' is made to communicate with a dust collector 60 through, for example, a cyclone 50, which is an abrasive tank. When a blower 61 provided for the above-described dust collector 60 sucks the interior atmosphere of the dust collector 60, the abrasive and dust recovered by the hopper 10' are transported outside the cabinet 3. The reusable abrasive can be separated from other dust and recovered (refer to FIG. 2 of Japanese Unexamined Patent Publication No. 2005-74563).

An opening at the top of the above-described hopper 10' is covered with, for example, a perforated metal mesh 22 that allows the abrasive to pass therethrough. This mesh 22 prevents, for example, a foreign matter from falling into the hopper 10'. At the same time, a metal grid 21 on which a workpiece W" is disposed is provided over this metal mesh, as required, thus separating the hopper 10' from the blasting chamber 2. The metal grid 21 and the metal mesh 22 define a bottom wall surface 20 of the blasting chamber 2.

In a blasting machine 1 constructed as described above where the hopper 10' shaped like an inverted quadrangular pyramid, is provided at the bottom of the cabinet 3, the abrasive ejected in the blasting chamber 2, dust generated by ejecting this abrasive, and so forth fall into the hopper 10' through the metal grid 21, the metal mesh 22, and so forth constituting the bottom wall surface 20 of the blasting chamber 2. Thereafter, the abrasive that has fallen into the hopper 10' is guided to a sloping inner wall of the hopper 10' and accumulates at the bottom of the hopper 10'. The accumulated abrasive is then introduced into a recovery pipe 30 that sucks the interior atmosphere of the blasting chamber 2 through the bottom of this hopper 10' and is transported outside the cabinet 3.

The abrasive transported as described above is introduced into the cyclone 50, also serving as an abrasive tank, to recover the reusable abrasive. The dust in the form of a residue after the abrasive has been recovered is introduced into the dust collector 60, where dust-free clean air is ejected outside through the blower 61. With the above-described structure, a recovery mechanism for recovering the abrasive and dust is provided.

As shown in FIG. 10, however, if the cabinet 3 is made larger, the hopper 10' also becomes larger because the hopper 10' is formed by tapering the lower part of the cabinet 3 towards the bottom thereof. As a result, the bottom wall surface 20 of the blasting chamber 2 formed by covering the opening at the top of this hopper 10' with the metal mesh 22, the metal grid 21, and so forth will be disposed at a higher position.

Thus, the structure shown in FIG. 10 has no problem in operation as long as the blasting machine 1 is small. However, if a blasting machine has the above-described structure and needs to process a large workpiece W, there is no choice but to make the blasting machine itself larger, thus also making the hopper 10' larger. Therefore, the distance from the bottom wall surface 20 of the blasting chamber 2 to the floor surface of a building where the blasting machine is installed becomes large. This makes it difficult to transport the workpiece W up into and down from the blasting chamber 2.

In particular, when a large workpiece W needs to be handled, it would be convenient if a large space can be secured in the blasting chamber 2, i.e., a space large enough for an operator to transport the workpiece W on a cart into the blasting chamber 2 and to handle the workpiece W in the blasting chamber 2. To do this, the hopper 10 needs to be made much larger. However, allowing a cart and an operator to smoothly enter the blasting chamber 2 involves a contradicting demand; that is, the position, i.e., height of the bottom wall surface 20 of the blasting chamber 2 from the above-described floor surface needs to be lower.

Such a demand could be satisfied even with the known structure of the blasting machine 1. More specifically, a groove or a dented portion large enough to accommodate the hopper 10' could be formed below the floor or in the base of a building where the blasting machine 1 is installed so that the hopper 10' can be housed in this groove, thereby causing the bottom wall surface 20 of the blasting chamber 2 to be substantially flush with the floor of the building.

This approach, however, is not only money- and labor-consuming in installing the blasting machine 1 but also requires extensive renovation of the floor, the base, and so forth of the existing building. In short, this approach is difficult to adopt for existing buildings.

Moreover, if the blasting chamber 2 becomes larger as the cabinet 3 becomes large, the recovery pipe for sucking the air in this blasting chamber, the duct, the cyclone, the dust collector, the blower, and so forth also need to be made large. This makes the overall machine large and increases the cost of the machine.

The present invention has been conceived in order to overcome the above-described problems associated with the conventional art. Thus, it is an object of the present invention to provide an abrasive-recovery mechanism in a blasting machine that allows the bottom wall surface of the blasting chamber to be disposed at a lowest possible position from the above-described floor without requiring extensive renovation of the floor, the base, and so forth of the building, while still employing a structure where a hopper for recovering the abrasive is disposed below the bottom wall surface of the blasting chamber.

It is another object of the present invention to provide an abrasive-recovery mechanism in a blasting machine that, even though the blasting chamber is made larger, can recover the abrasive and similar dust without increasing the sizes of the recovery pipe that sucks the interior atmosphere of the blasting chamber, the duct, the cyclone, the dust collector, the blower, and so forth or causing any problem such as clogging.

SUMMARY OF THE INVENTION

In the following explanation of the Summary, reference numerals are referred as of the Embodiment in order to easily read the present invention, however, these numerals are not intended to restrict the invention as of the Embodiment.

In order to achieve the above-described objects, an abrasive-recovery mechanism in a blasting machine according to the present invention includes mesh members (21, 22) that allow the abrasive to pass therethrough and divide a cabinet 3 of a blasting, machine 1 into an upper space and a lower space to form a blasting chamber 2 having a bottom wall surface 20 defined by the mesh members (21, 22).

A plurality of hoppers 10, substantially shaped like an inverted trapezoid in two-dimensional cross section or an inverted quadrangular pyramid in three-dimensional view, are disposed below the mesh members (21, 22) such that top portions of the plurality of hoppers 10 are opened toward the mesh members (21, 22) and the bottom end of each of these hoppers 10 is made to communicate with suction means of a dust collector 60 through a recovery pipe 30.

In the abrasive-recovery mechanism with the above-described structure, the hoppers 10 can be formed individually. However, it is preferable that dividing plates 13 substantially shaped like, for example, an inverted regular triangle to be disposed in each groove of a cross-sectionally W-shaped gutter 12 composed of two parallel grooves, such as 45° contiguous V-shaped grooves, at an angle of 45° to divide the space in each of the grooves into inverted quadrangular pyramid shapes, thus forming a set of two columns of the hoppers 10 (refer to FIGS. 4A and 4B and FIG. 8).

In this case, one recovery pipe 30 communicating with the bottom end of each of the hoppers 10 is attached to the above-described gutter 12 in which the set of two columns of the hoppers 10 are formed to form a recovery unit 18 such that the direction in which the hoppers 10 are arranged is defined as the length direction. Further, one or more of the recovery units 18 can be disposed below the mesh members (21, 22) (refer to FIGS. 4A and 4B and FIG. 8).

For the structure of the recovery pipe 30, the cross-sectional shape of the recovery pipe 30 is desirably a rectangle having a ratio of a long side to a short side of at least 1.5, and preferably, 2 to 3.5. Thus, the bottom end of each of the hoppers 10 can be made to communicate with the recovery pipe 30 at either end of the long side of the cross-section.

In this case, pipes 16, serving as stoppers, are provided for extending apertures 15 communicating between each of the hoppers 10 and the recovery pipe 30, and a protrusion length at a bottom end of each of the pipe 16 is set such that the pipe 16 terminates at a space in the recovery pipe 30.

Furthermore, a plurality of introduction conduits 31 for introducing external air into the recovery pipe 30 can be provided at regular intervals in the length direction of the recovery pipe 30 to eliminate any abrasive clogging the recovery pipe 30.

In addition, it is possible to provide directional control means realized by, for example, a solenoid-operated directional control valve for causing recovery pipes 30 to sequentially communicate with the above-described suction means for the recovery pipe 30 of each recovery unit 18 or for the recovery pipes 30 of a predetermined number of recovery units 18 .

With the above-described structure according to the present invention, the abrasive-recovery mechanism of the blasting machine according to the present invention can afford the following distinct advantages.

Since the abrasive on the bottom wall surface 20 of the blasting chamber 2 is recovered by the plurality of hoppers 10, the sizes of the individual hoppers 10 can be reduced even if the cabinet 3 is large, and therefore, the heights of these hoppers 10, accordingly, the distance from the bottom wall surface 20 of the blasting chamber 2 formed over these hoppers 10 to the floor surface can be reduced as far as possible.

Consequently, a workpiece W and an operator can be easily brought into and brought out from the blasting chamber 2 of the blasting machine 1. In addition, the workpiece W disposed on a cart can be brought into and out from the blasting chamber 2.

In the structure where a large number of hoppers 10 are simultaneously formed by dividing a cross-sectionally W-shaped gutter 12 with dividing plates 13, the hoppers 10 can be manufactured easily, compared with a case where hoppers are formed individually.

Furthermore, if a set of two columns of hoppers 10 are formed in each gutter 12, many sets of two columns of hoppers 10 can be formed merely by arranging gutters 12 in which such hoppers 10 are formed along the width direction. This saves time-consuming work when many hoppers 10 are installed.

In the structure including a plurality of recovery units 18, each recovery unit 18 including two columns of hoppers formed in a gutter 12 and one recovery pipe 30 attached to the gutter 12, the abrasive-recovery mechanism can be constructed merely by connecting recovery pipes 30(*n*) to a cyclone and the dust collector through one or more connection pipes 40 communicating with the recovery pipe 30 provided for each recovery unit 18 after the above-described recovery units 18 are disposed the bottom wall surface 20 of the blasting chamber 2 in the cabinet 3. This makes, for example, piping work extremely easy.

According to the above-described structure, compared with a case where a recovery pipe is provided for each column of the hoppers 10, the number of recovery pipes 30 is halved. In terms of this point, piping work becomes easy.

If the cross-sectional shape of the recovery pipe 30 is a rectangle, the same amount of the abrasive can be recovered with a low in-pipe wind velocity, compared with a case where recovery pipes 30 of other cross-sectional shapes are used. This suppresses wear of the recovery pipe 30 because a lower in-pipe wind velocity is sufficient.

Furthermore, even though the abrasive falling into the recovery pipe 30 from the hoppers 10 is accumulated in the recovery pipe 30, a space in which the abrasive does not easily fall or accumulate is secured in the center in the width direction of the recovery pipe 30 by making the bottom ends of the hoppers 10 communicate with the recovery pipe 30 at both ends of the long side of the cross-section of the recovery pipe 30. Due to air flow in this space, the recovery pipe 30 is not easily clogged.

In addition, in the structure where the extension pipes 16 for extending the apertures 15 communicating between the recovery pipe 30 and the bottom ends of the hoppers 10 are provided, even though the abrasive falling from the hoppers 10 is accumulated in the recovery pipe 30, further falling of the abrasive stops when this accumulation of the abrasive reaches the bottom-end positions of the extension pipes 16. This prevents an excessive abrasive from falling into the recovery pipe 30 and further makes it difficult for the recovery pipe 30 to be clogged.

Furthermore, in the structure where the introduction conduits 31 are provided, even if clogging occurs in a recovery pipe 30, this clogging can be easily eliminated by a predetermined operation.

In the structure where sucking is carried out for the recovery pipe of each recovery unit 18 or for the recovery pipes of a predetermined number of recovery units, the sizes of the duct, cyclone, dust collector, blower, and so forth can be reduced, compared with a case where sucking is carried out for all the recovery pipes 30 simultaneously. Because of this, the size of the entire blasting machine can also be reduced. Furthermore, this type of the abrasive-recovery mechanism can be provided at low cost.

BRIEF DESCRIPTION OF THE DRAWINGS

The objects and advantages of the invention will become apparent from the following detailed description of preferred embodiments thereof provided in connection with the accompanying drawings in which:

FIGS. 4A and 4B are cross-sectional views of the recovery unit having a set of two columns of hoppers formed therein, in which FIG. 4A is a cross-sectional view taken along line A-A of FIG. 3 and FIG. 4B is a cross-sectional view taken along line B-B of FIG. 3;

FIGS. 6A to 6D illustrate various cross-sectional shapes and their respective heights, assuming the cross-sectional areas are the same, in which FIG. 6A shows a rectangle in cross section, FIG. 6B shows a square in cross section, FIG. 6C shows a circle in cross section, and FIG. 6D shows a rhombus in cross section;

FIGS. 7A and 7B illustrate a recovery pipe provided for each column of hoppers, in which FIG. 7A shows a rectangular tube in cross section, and FIG. 7B shows a circular tube in cross section;

FIGS. 9A and 9B are cross-sectional views of a recovery unit provided with air introduction pipes for removing any abrasive or other dust blocking a recovery pipe 30, in which FIG. 9A is a cross-sectional view taken along the width direction, and FIG. 9B is a cross-sectional view taken along the length direction.

DETAILED DESCRIPTION OF THE PREFERRED EMBODIMENTS

Figure 1:
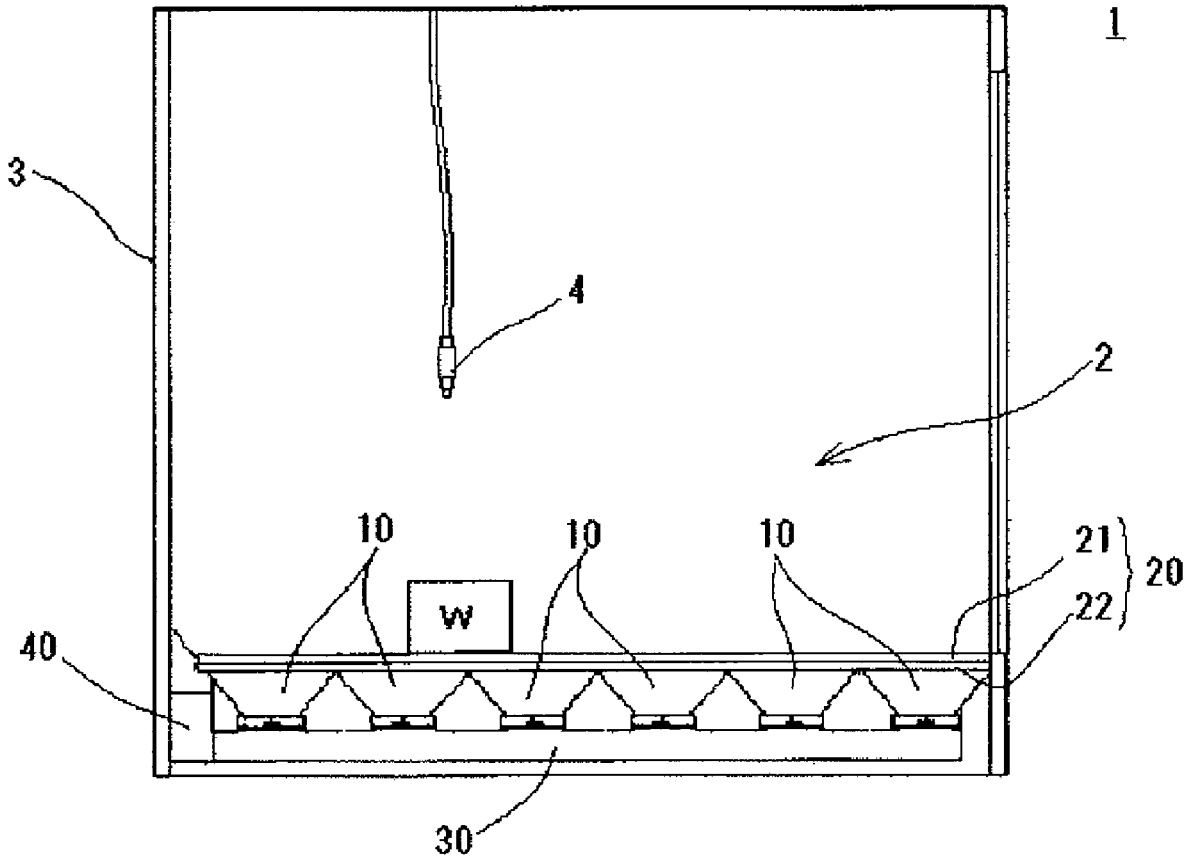
FIG. 1 is a schematic diagram of a blasting machine in an embodiment according to the present invention (same in the following drawings)

Embodiments according to the present invention will now be described with reference to the drawings. However, the present invention is not limited to the examples depicted in the drawings.

Overall Structure of Blasting Machine

Referring to FIG. 1, reference numeral 1 denotes a blasting machine including an abrasive-recovery mechanism according to the present invention. This blasting machine 1 includes a cabinet 3 having a space in which a blasting chamber 2 is formed.

This cabinet 3 is shaped like a box having a space therein. An openable/closable door and a transport entrance covered with, for example, a flexible sheet are provided at a part of a wall surface of the cabinet 3 so that a workpiece W and an operator can enter the cabinet 3 through this transport entrance as required.

An abrasive-ejecting machine, such as an ejection nozzle 4, for ejecting the abrasive onto the workpiece W is housed in this cabinet 3. When the abrasive is ejected onto the workpiece W in the cabinet 3, blasting can be carried out without causing the abrasive or dust to leak out of the cabinet 3.

Although the example in the figure shows a structure in which an operator enters the cabinet 3 and operates the ejection nozzle 4 to process the workpiece W, this ejection nozzle 4 may be attached to, for example, the tip of a robot arm disposed in the cabinet 3 so that the operator can process the workpiece W without entering the cabinet 3.

Hoppers 10 constituting a part of the recovery mechanism for recovering the abrasive ejected inside, dust generated by this ejection, and so forth are provided below the space formed in this cabinet 3. The tops of these hoppers 10 are covered with a metal mesh 22 and/or a metal grid such as a grating 21 so that this metal mesh 22 and/or the grating 21 function as a bottom wall surface 20. The blasting chamber 2 for carrying out blasting is formed above this bottom wall surface 20.

Figure 2:
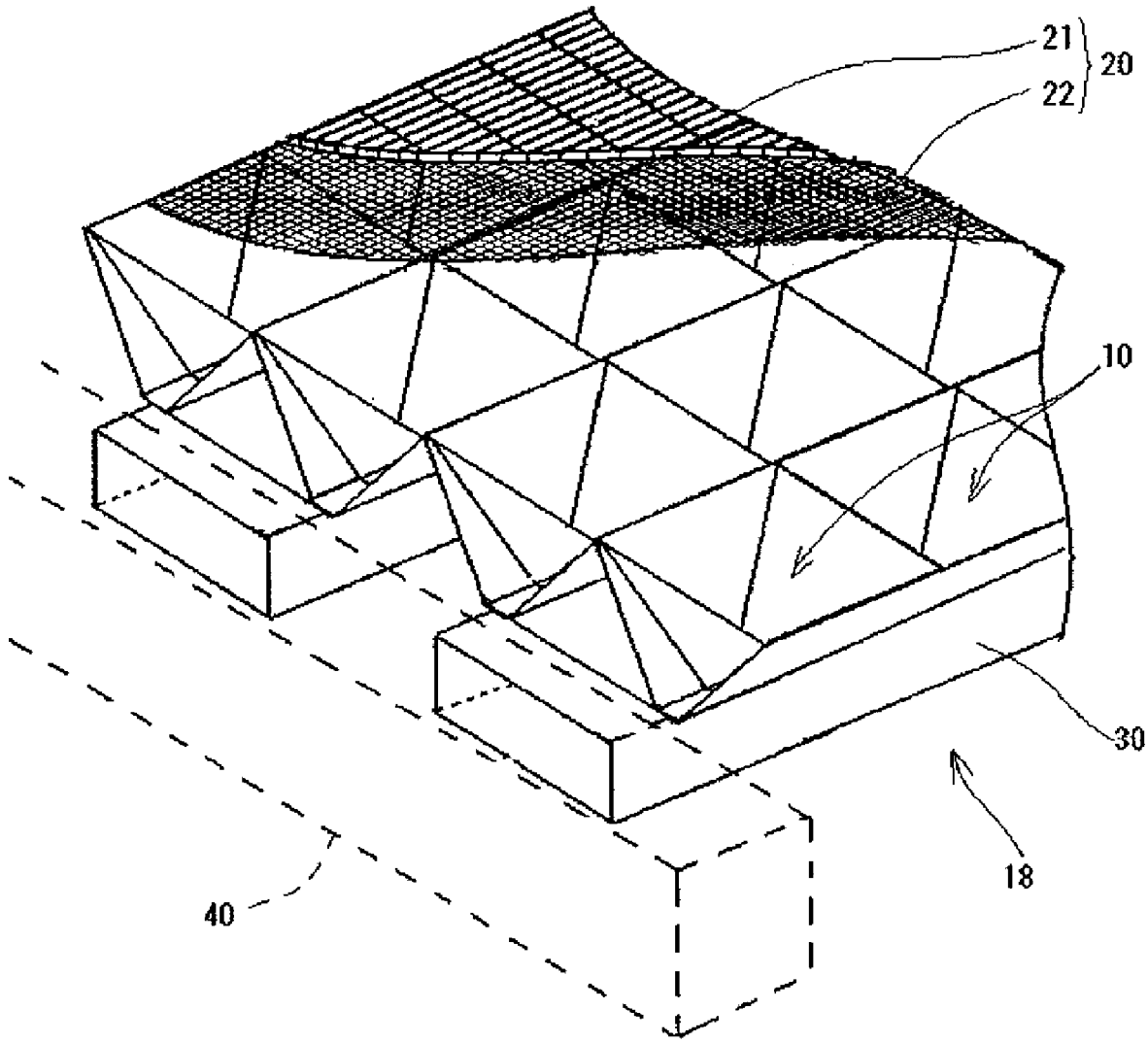
FIG. 2 is a schematic perspective view of hoppers, illustrating adjacent sets of hoppers each set composed of two columns of hoppers provided below the bottom wall surface of a blasting chamber.

Referring now to FIG. 2, many compact hoppers 10 are arranged below the bottom wall surface 20 of the blasting chamber 2. The rectangular openings at the tops of the hoppers, defining the bottom wall surface 20 of the blasting chamber 2, are arranged in a so-called grid-pattern, that is, in the form of contiguous squares whose four sides are adjacent to one another.

The bottom-end portions of the hoppers 10 communicate with recovery pipes 30, which are joined by means of, for example, a connection pipe 40.

Although not shown in the figure, the connection pipe 40 joining the recovery pipes 30 as described above communicates with a dust collector through, for example, a cyclone in the same manner as with the conventional art described with reference to FIG. 10. When the interior atmosphere of the recovery pipes 30 are sucked by a blower provided in this dust collector, the abrasive is recovered by the hoppers 10, and the abrasive that has fallen into the recovery pipes 30 is introduced into the cyclone and recovered. Thereafter, dust generated after the above-described abrasive has been removed is recovered by the dust collector.

Hoppers

Figure 10:
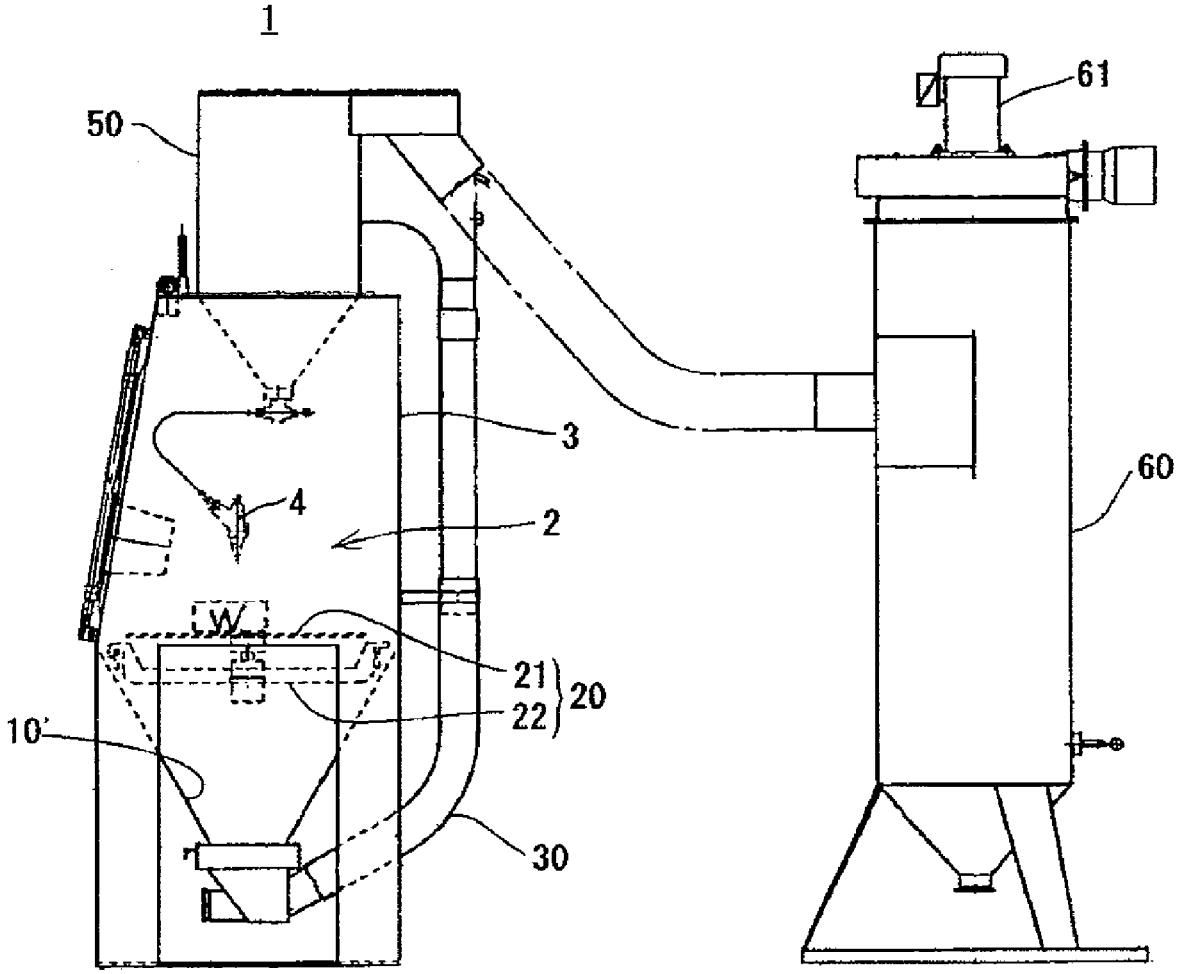
FIG. 10 is an illustration of a typical (known) blasting machine.

Referring to FIG. 10, in the blasting machine 1 described as conventional art, a relatively large, single hopper 10' extended from the inner wall of the blasting chamber 2 is provided below the cabinet 3 so as to recover the abrasive and dust in the blasting chamber 2. In the recovery mechanism according to the present invention, on the other hand, a large number of the hoppers 10 that are all shaped like an inverted quadrangular pyramid are arranged below the bottom wall surface, accordingly, the individual hoppers 10 are made compact to reduce the height thereof, thereby reducing the vertical position of the bottom wall surface 20 of the blasting chamber 2 relative to the floor.

Figure 3:
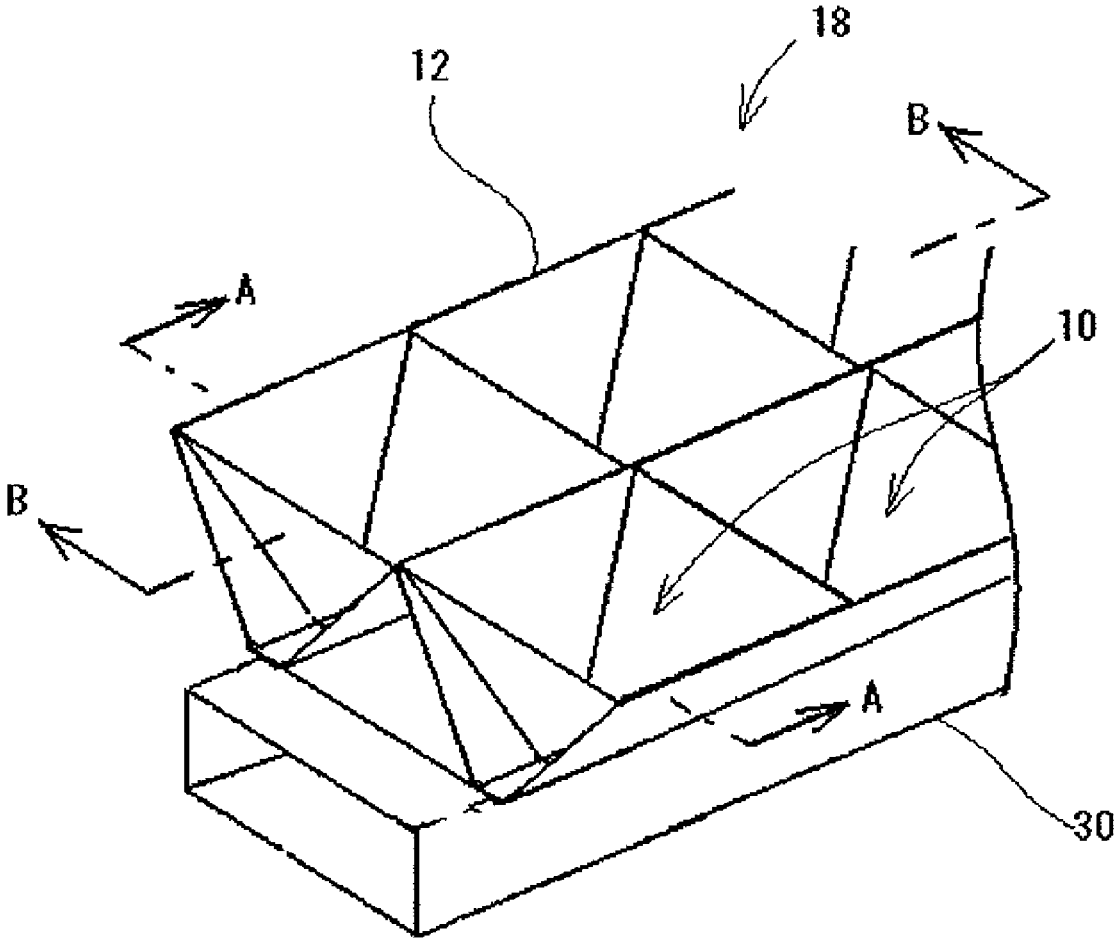
FIG. 3 is a perspective view of a recovery unit having a set of two columns of hoppers formed therein.
Figure 4A:
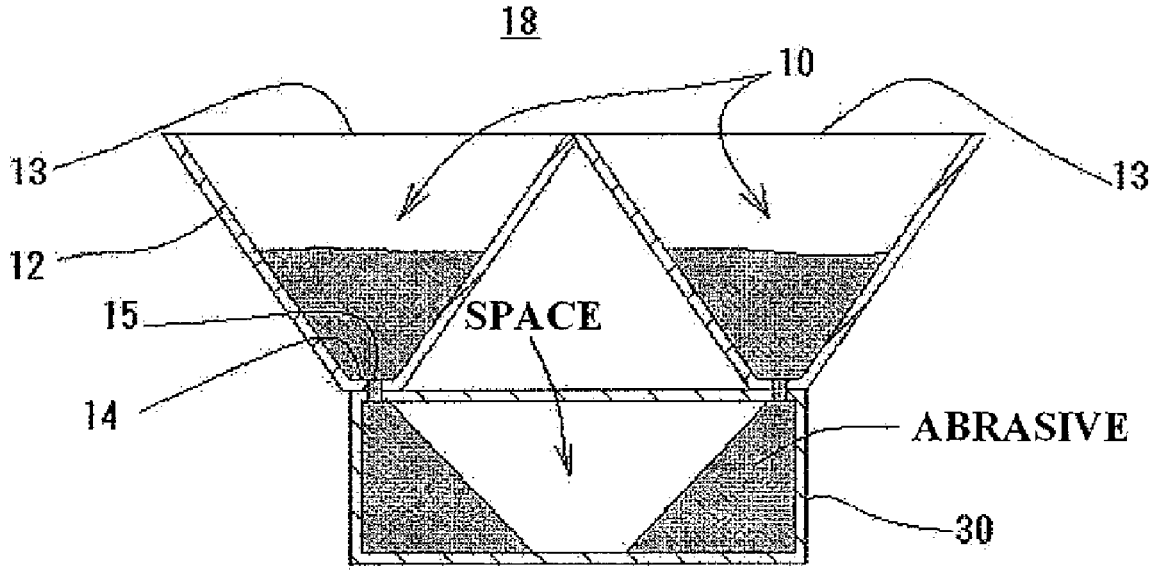
Figure 4B:
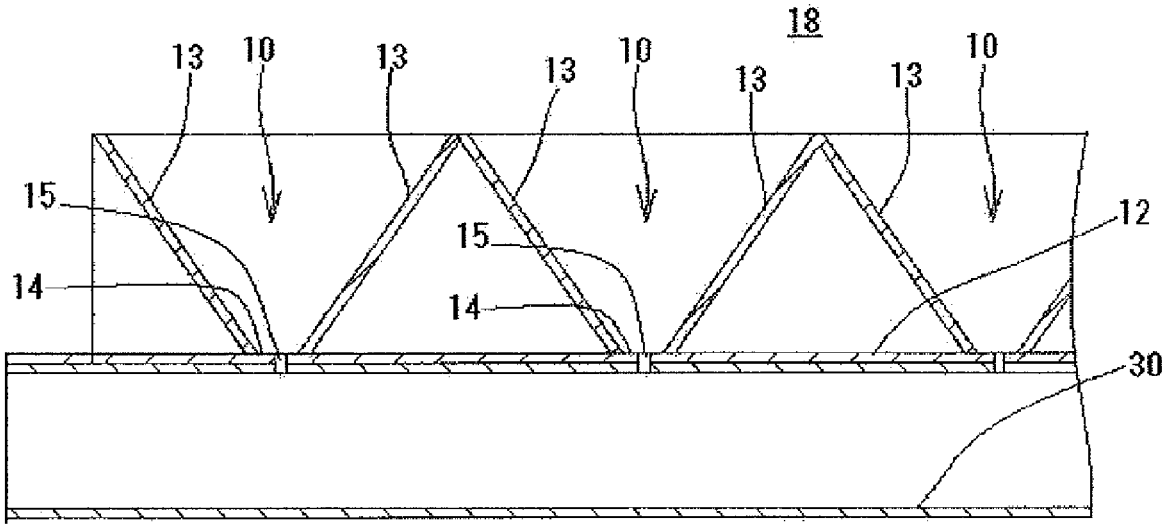

As shown in FIG. 2, the entire structure of the hoppers 10 may be constructed by arranging individually formed hoppers 10 on, for example, a pedestal (not shown in the figure) installed on, for example, a steel plate making up the framework of the bottom wall of the blasting chamber 2 so that the bottom wall surface 20 of the blasting chamber 2 is compartmentalized into contiguous squares whose four sides are adjacent to one another (i.e., grid-pattern). Referring to FIG. 3 and FIGS. 4A and 4B, according to this embodiment, however, each V groove of a gutter 12 that has a substantially W shape in cross section is divided by dividing plates 13 formed symmetrically in the longitudinal direction of the groove into an inverted quadrangular pyramid to simultaneously form a plurality of the hoppers 10 arranged in each set of two columns.

Positions of Top Openings and Bottom Wall Surfaces of Hoppers

To lower the position of the bottom wall surface 20 formed in the cabinet 3, the sizes of the individual hoppers 10 need to be shrunk to reduce the heights of the individual hoppers 10. As described above, however, if the hoppers 10 are to be manufactured individually, the smaller the size of each hopper 10, the more difficult it is to manufacture. More specifically, a hopper with a top opening having a size of about 700×700 mm and a height of about 550 mm is the smallest possible in practice. In short, it is difficult to make a hopper smaller than the above-described size and, therefore, to lower the position of the bottom wall surface of the blasting chamber more than the above-described height.

Referring again to FIG. 3 and FIGS. 4A and 4B, if the contiguous hoppers 10 are to be formed by the use of the gutters 12 shaped like a W shape in cross-section, the individual hoppers 10 can be formed through the relatively simple process of attaching the dividing plates 13. Therefore, it is relatively easy to make the top opening of each hopper 10 have a size of 200 to 300 mm square. Furthermore, it is possible to restrain the height of each hopper to about 350 mm, thereby further reducing the height of the bottom wall surface 20 of the blasting chamber 2 from the floor surface.

The size of the top opening of each hopper 10 is not limited to 200 to 300 mm square but can be increased more than the above-described figures according to the application and/or the size of the blasting machine 1. For example, according to this embodiment, hoppers with several different opening sizes of 200 mm square, 270 mm square, 330 mm square, 400 mm square, 500 mm square, and so forth are prepared so that a hopper with an opening of the optimal size can be selected according to the size of the cabinet 3 manufactured, the application, the amount of the abrasive to be used (recovery amount), and so forth. In accordance with hopper openings of these different sizes, the above-described W-shaped gutters 12 are also available in different sizes.

Referring to FIG. 3 and FIG. 4A, for this gutter 12 which has a W shape in cross section, the portion serving as the groove bottom is formed flat to have a small width, and when the dividing plates 13 (described below) are attached to form a hopper 10, the hopper 10 is endowed with a flat bottom 14.

Recovery Pipe and Aperture

The reverse surface of the bottom 14 is connected with the recovery pipe 30 one end of which communicates with the dust collector to suck the interior atmosphere of the recovery pipe 30. In addition, an aperture 15 passing through the above-described bottom 14 and the side wall of the recovery pipe 30 is formed so that the abrasive in the hopper 10 falls into the recovery pipe 30.

This aperture 15 is formed large enough to allow, for example, the abrasive delivered into the hopper 10 to fall a constant amount at a time into the recovery pipe 30. In fact, apertures 15 are formed as small holes so that the sum of the amounts of wind to be introduced into the recovery pipe 30 through these apertures 15 has a small ratio, preferably about 1/10, relative to the amount of wind flowing in the recovery pipe 30.

Therefore, air introduced through these apertures 15 causes no large change in the amount of wind or wind velocity in the recovery pipe 30. This ensures a stable capability to recover the abrasive falling into the recovery pipe 30.

For example, if the cross-sectional shape of the recovery pipe 30 (cross-section of the flow channel) is a rectangle with a size of, for example, 250 mm×100 mm, the cross-sectional area is 25,000 $mm^2$. If a total of 16 holes each having a diameter of 14 mm are formed as the above-described apertures 15, the ratio of the above-described cross-sectional area (25,000 $mm^2$) to the total area of the holes (2,463 $mm^2$) is about 10 to 1. This level of ratio is sufficient to maintain the wind velocity substantially constant.

Furthermore, since the aperture 15 formed in the bottom 14 of each hopper 10 is small, a constant amount of the abrasive per unit time can fall, even though a large amount of the abrasive is delivered into the hoppers 10 at a time. As a result, the recovery pipe 30 is prevented from being clogged.

For example, dividing plates 13 shaped like an inverted regular triangle having a size same as the size of one of the contiguous 45° V grooves constituting a W-shaped gutter 12 are inserted into each of the above-described grooves at an angle of 45° to compartmentalize the space in the gutter 12 which is W-shaped in cross-section, thus forming many hoppers 10 shaped like an inverted quadrangular pyramid. More specifically, the interior of the groove can be compartmentalized into the hoppers 10, which are shaped like an inverted quadrangular pyramid, by inserting pairs of the above-described dividing plates 13, shaped like an inverted triangle, into the space in the above-described groove at constant intervals and at a predetermined angle of inclination of 45° and by welding two contiguous sides in contact with each other.

Figure 5:
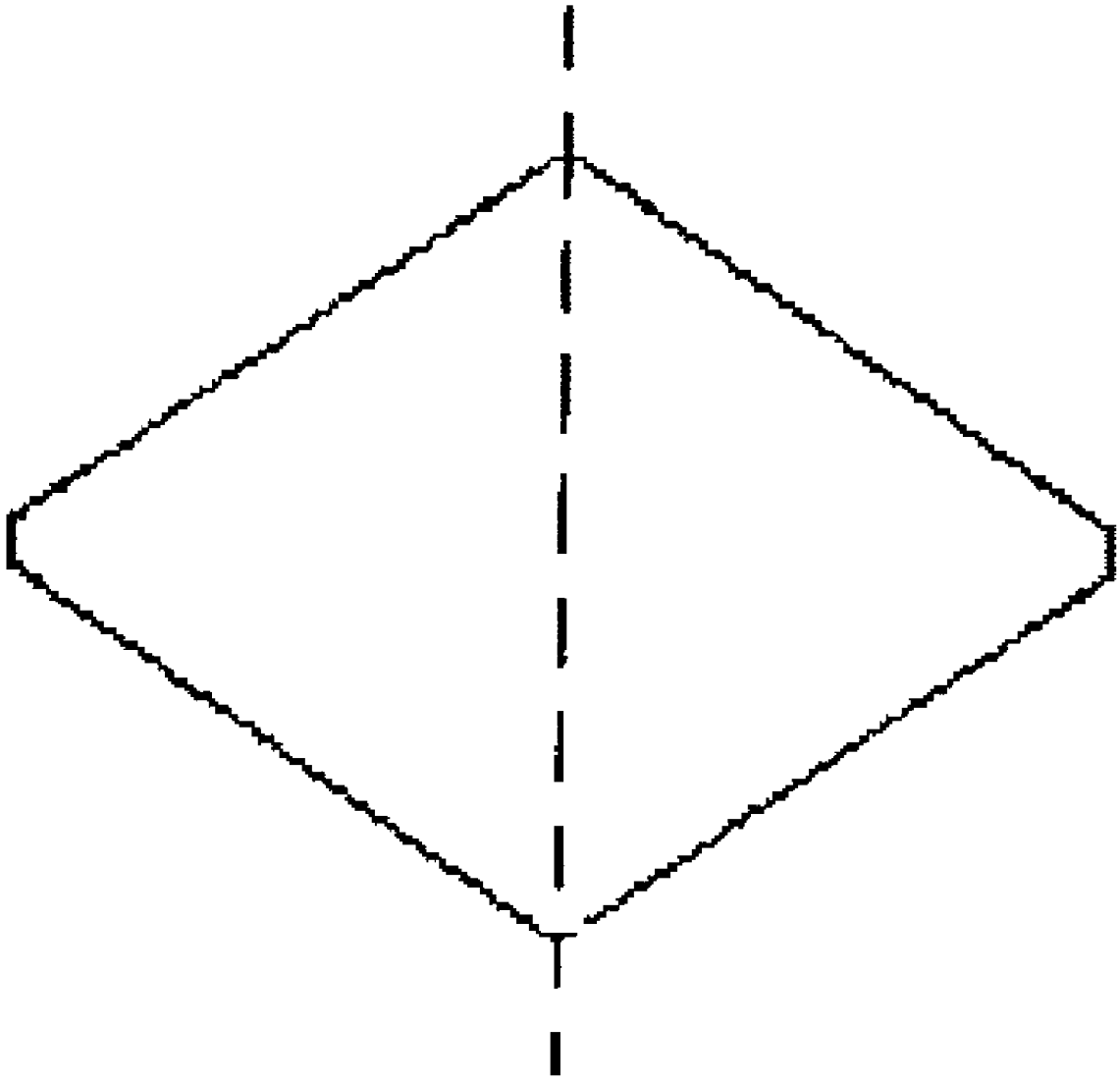
FIG. 5 is a plan view of a modification of a dividing plate.
Figure 6A:
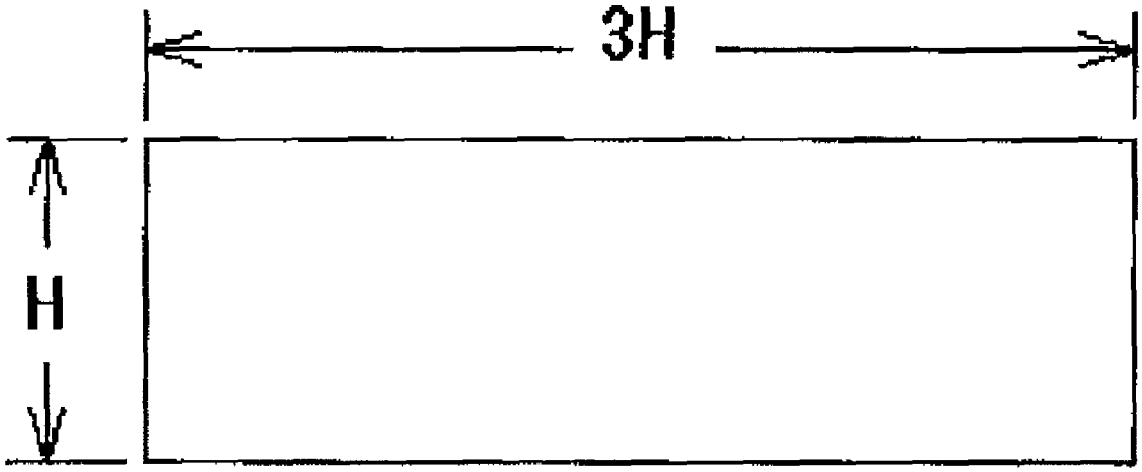
Figure 6B:
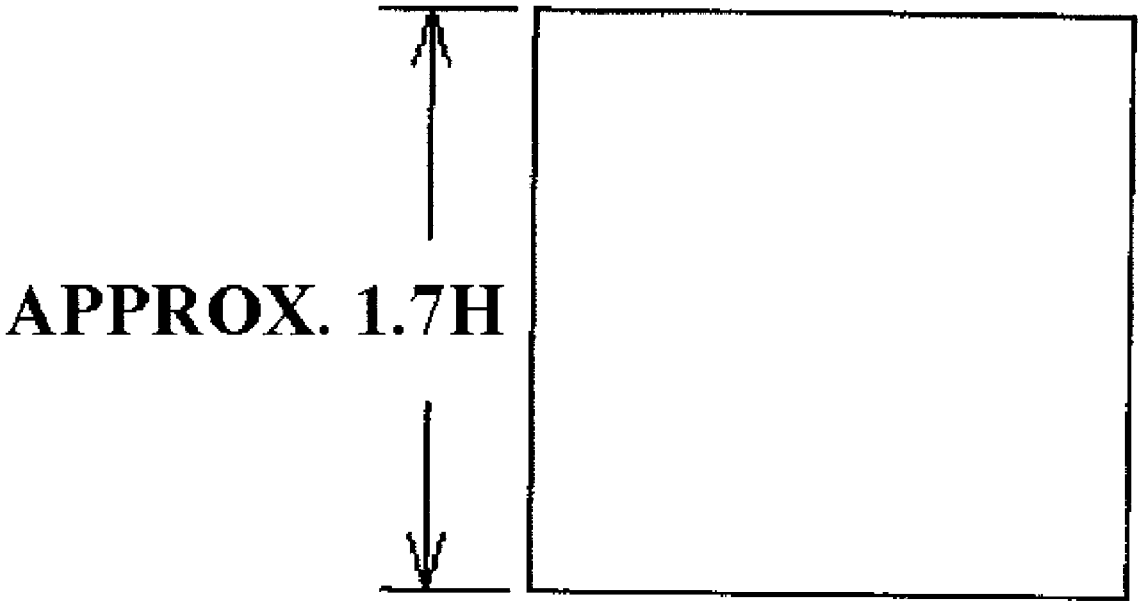
Figure 6C:
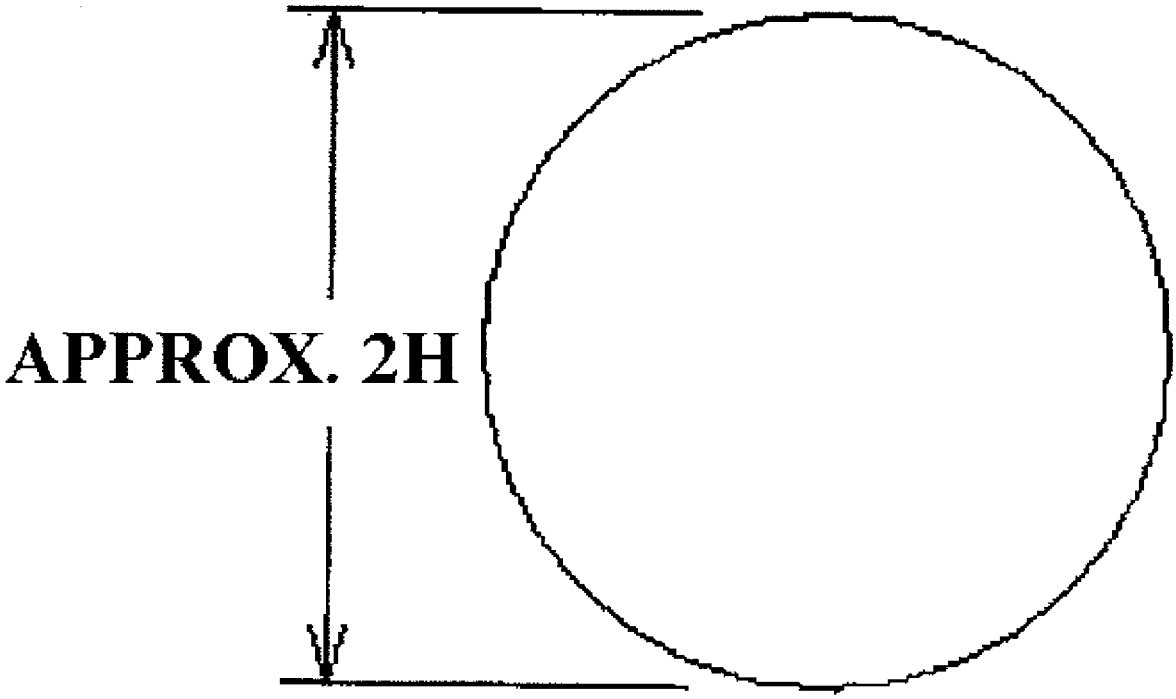
Figure 6D:
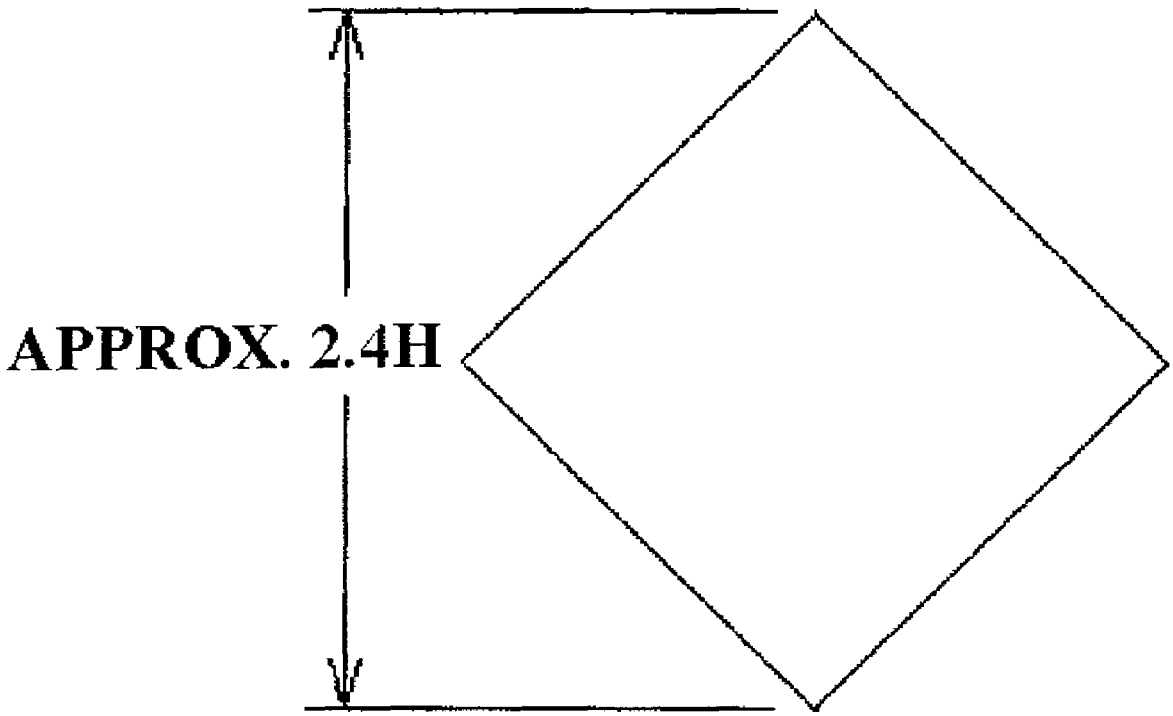

Referring to FIG. 5, the dividing plates 13 may be in the form of two contiguous dividing plates 13, which are obtained by folding, for example, a substantially rhombic plate at the dotted center line. A hopper 10 can be formed by inserting these two dividing plates 13 into a V-shaped groove of the W-shaped gutter 12 and fastening the plates 13.

In this manner, compared with the case where the hoppers 10 are manufactured individually as described above, it is easy to manufacture the hoppers 10 and also to make the hoppers 10 compact by forming a plurality of the hoppers 10 simultaneously by compartmentalizing the grooves of the gutters 12, which have a W shape in cross section. Furthermore, since two columns of the hoppers 10, constituting one set, are simultaneously formed, the installation of the hoppers 10 can be completed easily without requiring time-consuming work by arranging a predetermined number of gutters 12 composed of the hoppers 10 manufactured as described above.

The hoppers 10 formed as described above have the bottom ends thereof disposed on the horizontally arranged recovery pipes 30. The abrasive recovered by the hoppers 10 falls into the recovery pipes 30 through the apertures 15 penetrating both the bottoms 14 of the hoppers 10 and the wall surfaces of the recovery pipes 30.

As described above, one end of each of these recovery pipes 30 is connected to and communicates with the dust collector, serving as suction means, through, for example, the connection pipe 40 and the cyclone. The other end of each recovery pipe 30 is opened so as to introduce a certain amount of air thereinto. Thereby, when the interior atmosphere in each recovery pipe 30 is sucked from one end thereof by the dust collector, a certain amount of air is introduced into the recovery pipe 30 from the other end thereof, thus generating air flow with a predetermined wind velocity in the recovery pipe 30.

As a result, the abrasive falling into the recovery pipes 30 through the above-described apertures 15 is sucked into the dust collector together with the air flowing in the recovery pipes 30 and is transported outside the cabinet 3.

Although these recovery pipes 30 are available in various shapes, the shape of each recovery pipe 30 may be elliptical or rectangular in cross-section with a ratio of the horizontal width to the vertical width of preferably 1.5 or more and, preferably, 2 to 3.5. More preferably, the recovery pipes 30 should be rectangular in cross section, as shown in FIG. 3 and FIGS. 4A and 4B.

Recovery Capability of Recovery Pipes

The inventors conducted the following experiment as to recovery capability in order to determine the most appropriate structure of the recovery pipe according to the present invention.

Recovery pipes that are respectively square, circular, and rhombic (square rotated by 45°) in cross-section were used instead of the recovery pipes 30, which are rectangular in cross-section. Assuming that all recovery pipes have the same cross-sectional area, the ratios of the recovery capability (the amount of the abrasive recovered with the same in-pipe wind velocity) were measured. The results were 2.5 for the recovery pipe that is rectangular in cross-section with a vertical-to-horizontal ratio of 1:2.5; 2 for the recovery pipe that is square in cross-section; 1.5 for the recovery pipe that is circular in cross-section; and 1 for the recovery pipe that is rhombic in cross section. As a result, the recovery pipe that is rectangular in cross-section exhibited the largest value.

The direction in which a set of two columns of the hoppers 10 formed in each gutter 12 are arranged was defined as the length direction of the above-described recovery pipes 30. The bottoms 14 of the hoppers 10 in each column were made to communicate with the recovery pipes 30 through the apertures 15 disposed at both ends of the long side of the cross-section taken along the width direction. The abrasive recovered in the hoppers 10 was made to fall into the recovery pipes 30 through the above-described apertures 15.

As described above, as a result of the bottom ends of the hoppers 10 in each column communicating with the recovery pipes 30 at both ends of the long side of the cross-section of the recovery pipes 30, a space into which no abrasive falls is formed at the center portion in the width direction of the recovery pipes 30, as shown in FIG. 4A, even though the abrasive falls simultaneously from one column of the hoppers 10 and the other column of the hoppers 10. Therefore, the recovery pipes 30 are not easily clogged even though the abrasive falls into the recovery pipes 30 during a period of time in which the interior atmosphere of the recovery pipes 30 are not sucked, let alone a period of time during which the interior atmosphere in the recovery pipes 30 are being sucked, because, for example, an intermittent sucking approach is adopted.

Furthermore, since a single, common recovery pipe 30 is used for every two columns of the hoppers 10 as described above, the installation of the recovery pipes 30 can be performed easily.

Wind Velocity in Recovery Pipes

When the wind velocity in the recovery pipes 30 is increased, wear of the inner walls of the recovery pipes 30 due to the abrasive is increased. Therefore, the recovery pipes 30 need to be replaced, maintained, and so forth more frequently. However, the structure according to this embodiment where the recovery pipes 30 are rectangular in cross-section exhibits a superior recovery capability, compared with other shapes, as described above. Therefore, even when the wind velocity in the recovery pipes 30 is lower than those for recovery pipes of other shapes, it is possible to recover a sufficient amount of the abrasive.

Consequently, the recovery pipes 30 are prevented from being severely worn by adopting a relatively low wind velocity while still maintaining satisfactory abrasive recovery efficiency. This saves labor and reduces the cost associated with replacement, maintenance, and so forth of the recovery pipes 30.

Referring to FIG. 6, a recovery pipe that is rectangular in cross-section can have a lower height than recovery pipes of the above-described other shapes, assuming that the cross-sectional areas are the same. As a result, the use of a recovery pipe that is rectangular in cross-section is also advantageous in lowering the height of the bottom wall surface 20 of a blasting chamber 2.

Figure 7A:
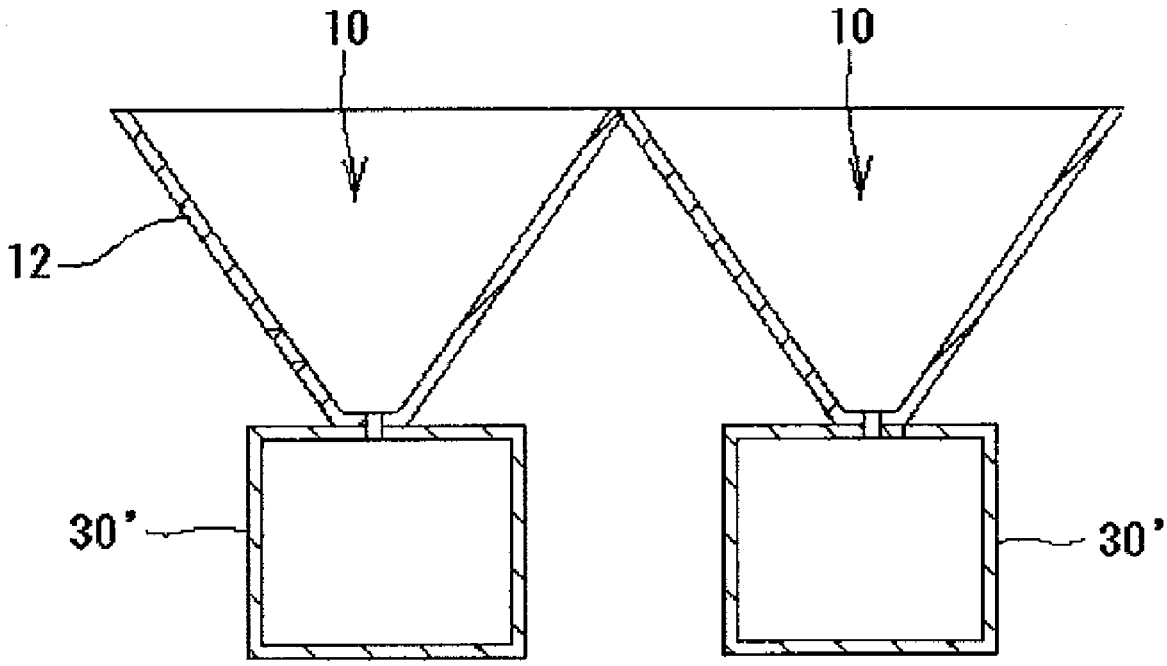
Figure 7B:
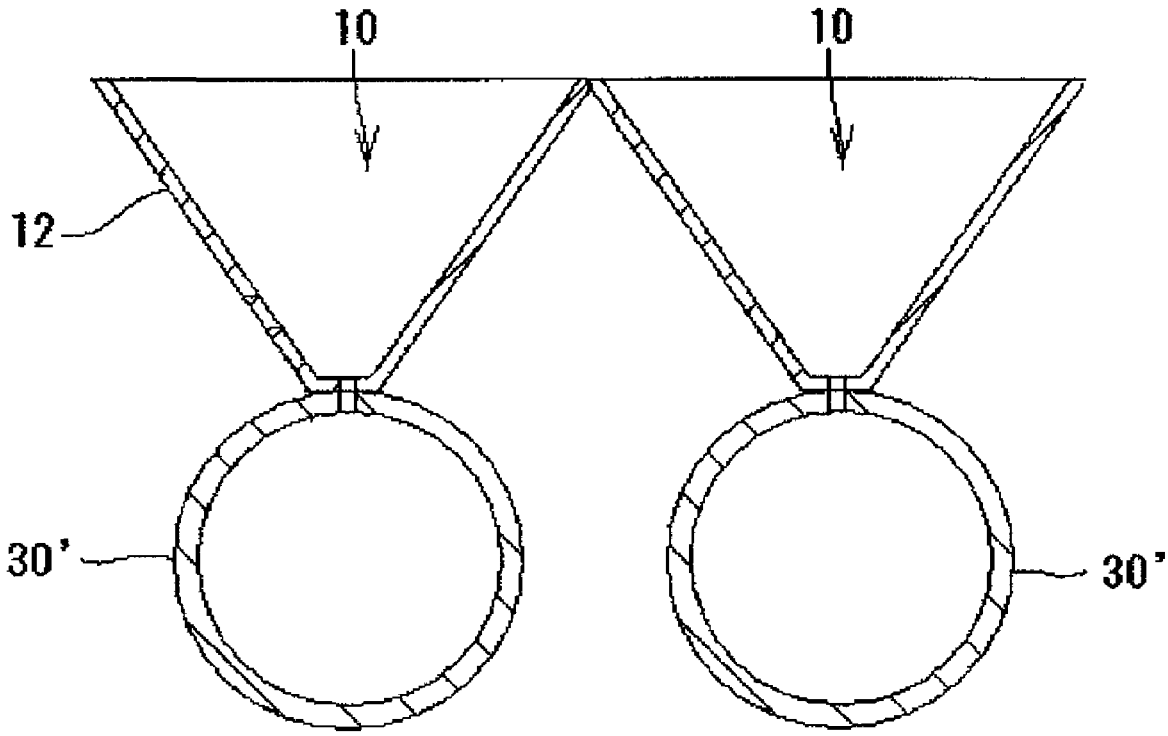

Referring to FIG. 7, to lower the height of a recovery pipe, a recovery pipe 30' can be provided for each column of the hoppers 10. If this structure is adopted, however, the number of employed recovery pipes 30' is doubled, and installation work and piping work become complicated.

A structure in which one recovery pipe 30 that is rectangular in cross-section is shared by a set of two columns of hoppers is advantageous in that the height of the recovery pipe can be reduced without requiring any time-consuming piping work or installation work.

The recovery pipes 30 have no protrusions therein. Furthermore, each of the recovery pipes 30 can be a straight pipe, assuming that the column direction of a set of two columns of the hoppers 10 is defined as the length direction. In the formation of curved portions for the purpose of, for example, the joining of the recovery pipes 30, the recovery pipes 30 can be made substantially free of wear by establishing connection via, for example, the connection pipe 40 provided separately from the recovery pipes 30. That is, once installed, the recovery pipes 30 are almost maintenance-free and can be used semi permanently.

Consequently, for example, maintenance can be completed by, for example, replacement of, for example, the above-described connection pipe 40 provided near the wall surface of the cabinet 3, where working is relatively easy to do. This provides high maintainability.

Relationship Between Width (Area of the Top Opening) of Gutter and Cross-Sectional Area of Recovery Pipe Although the sizes of the recovery pipes 30 can be made constant regardless of the size of the bottom wall surface or the size of each hopper 10, they should preferably be changed according to the size of the bottom wall surface and the size of each hopper 10.

For example, for the relationship between the size of a recovery pipe 30 and the length of a hopper column (the depth of the blasting chamber), a recovery pipe that is a 110 mm×320 mm rectangle in cross-section may be used if the length of the hopper column (the depth of the blasting chamber) is 6 m or more or the amount of the ejected abrasive (i.e., the amount of the recovered abrasive) is large, assuming that the basic size of the recovery pipe 30 is 100 mm×250 mm in cross-section.

Furthermore, for this embodiment, every two columns of the hoppers 10 with top opening sizes of 200 mm square, 270 mm square, 330 mm square, 400 mm square, and 500 mm square were formed in the W-shaped gutters 12 with widths of 400 mm, 540 mm, 660 mm, 800 mm, and 1000 mm. They were used in combination with the rectangular recovery pipes 30 having, for example, the following sizes.

TABLE 1

Examples of width of W-shaped gutter and cross-sectional shape of recovery pipe used.

| Width of W-shaped gutter (mm) | Cross-sectional size of recovery pipe (mm) |
|---|---|
| 400 (hopper: 200 mm square) | 160 × 70 (equivalent to ϕ120) |
| 540 (hopper: 270 mm square) | 250 × 100 (equivalent to ϕ180) |
| 660 (hopper: 330 mm square) | 320 × 115 (equivalent to ϕ216) |
| 800 (hopper: 400 mm square) | 400 × 140 (equivalent to ϕ267) |
| 1000 (hopper: 500 mm square) | 500 × 160 (equivalent to ϕ318) |

The lengths of the recovery pipes 30, accordingly, the number of hoppers 10 that can be made to communicate with one recovery pipe 30 can be determined based on, for example, the ratio to the total area of the apertures 15 formed in the bottoms 14 of the hoppers 10. The total area of the apertures 15 formed in one recovery pipe 30 needs to be 15% or less of the cross-sectional area of the recovery pipe 30.

More specifically, if the total area of the apertures 15 is 15% or less of the cross-sectional area of the recovery pipe 30, an increase in wind velocity in the recovery pipe 30 can be restricted to 15% or less. For a wind velocity of, for example, 15 m/s near the air inlet of a recovery pipe 30, the wind velocity can be restricted to about 17.3 m/s near the exit. For a wind velocity of, for example, 18 m/s near the inlet, the wind velocity can be restricted to about 20.7 m/s near the exit. Thus, wear of the recovery pipes 30 can be prevented from increasing due to an extreme increase in wind velocity.

Installation of Each Unit and Suction in Recovery Pipe

A set of two columns of the hoppers 10 and one recovery pipe 30 provided for this set of two columns of the hoppers 10 constitute one recovery unit 18, which is installed on the pedestal to arrange a large number of the hoppers 10 at a portion serving as the bottom wall surface 20 of the blasting chamber 2.

The above-described pedestal has, for example, a depth of 2.2 m as a basic size. The depth can be adjusted in multiples of 1.1 m, which is half the above-described basic size of 2.2 m.

The basic depth of the pedestal was set as 2.2 m taking into consideration the convenience of transportation and installation work. The depth of the pedestal, however, is not particularly limited to this size. The material making up the pedestal can be shared by setting a basic predetermined size for the depth in this manner, regardless of the size of the blasting machine 1 to be formed. In addition, labor and costs associated with the design of the blasting machine can be saved.

A required number of the above-described recovery units 18 are arranged in the width direction of the pedestal for installation, and the required area of the bottom wall surface is covered. Furthermore, the bottom wall surface 20 of the blasting chamber 2 is formed by stacking the metal mesh 22 and/or the grating 21 on the top openings of these hoppers 10.

According to this embodiment where the above-described recovery unit 18 is available in a plurality of widths (width of the W-shaped gutter 12), including 400 mm (the top opening of each hopper is 200 mm square), 540 mm (the top opening of each hopper is 270 mm square), 660 mm (the top opening of each hopper is 330 mm square), 800 mm (the top opening of each hopper is 400 mm square), and 1000 mm (the top opening of each hopper is 500 mm square), the basic size is determined by adding the width of the square pipe used as the pedestal (i.e., 100 mm) to the width of each recovery unit 18, and the width of the bottom wall surface to be formed is determined in multiples of the above-described basic size, according to the number of recovery units 18 arranged in the width direction for installation.

The number of square pipes used as the pedestals is not necessarily one per recovery unit 18. The size can be increased or decreased by about 10% of multiples of the above-described basic value.

One example of the relationship between the width of the recovery unit 18 to be used and the width of the bottom wall surface formed by the recovery unit 18 is shown in Table 2.

TABLE 2

Relationship between width of recovery unit and width of floor surface to be formed

| Unit width (mm) approx. | Recovery pipe size (mm) | No. of units | Width of pipe for pedestal Total (mm) | Width of bottom wall surface (mm) |
|---|---|---|---|---|
| 540 | 250 × 100 equivalent to ϕ180 | 3 | 200 | 1800 |
| | | 4 | 300 | 2460 |
| | | 5 | 400 | 3140 |
| | | 6 | 500 | 3740 |
| 660 | 320 × 115 equivalent to ϕ216 | 3 | 200 | 2180 |
| | | 4 | 300 | 2940 |
| | | 5 | 400 | 3700 |
| | | 6 | 500 | 4460 |
| 800 | 400 × 140 equivalent to ϕ267 | 3 | 200 | 2600 |
| | | 4 | 300 | 3500 |
| | | 5 | 400 | 4400 |
| | | 6 | 500 | 5300 |

This embodiment employs a dual structure in which the metal mesh 22 is disposed over the top openings of the hoppers 10 and, furthermore, the grating 21 having slit-shaped openings of a predetermined width is provided. For example, if large pieces of foreign matter which cannot pass through the apertures 15 formed in the bottoms 14 of the hoppers 10 are present on the bottom wall surface 20, this foreign matter is prevented from falling into the hoppers 10 disposed below the bottom wall surface by the grating 21 and/or the metal mesh 22, thus preventing the hoppers 10 from being clogged.

Disposing the metal mesh 22 and/or the grating 21 over the hoppers 10 may be realized in the following manner. The bottom wall surface 20 of the blasting chamber 2 is compartmentalized into, for example, about 500 to 600 mm squares. Thereafter, a metal mesh 22 having a size corresponding to the compartmentalized size the bottom wall surface 20 of the blasting chamber 2 is stacked on each compartment, and then, a grating 21 having a size same as the size of the metal mesh 22 is stacked on each metal mesh 22.

With the metal mesh 22 and/or the grating 21 provided for each compartment whose size is about 500 to 600 mm square as described above, when each hopper 10 disposed below the bottom wall surface is to be inspected, the grating 21 and/or the metal mesh 22 can be removed separately for each 500 to 600 mm square.

If the top opening of each hopper is formed into, for example, a 200 to 300 mm square, one compartment contains 2-row×2-column to 3-row×3-column hoppers. The hoppers 10 in the above-described units can be exposed at a time by removing the metal mesh 22 and/or the grating 21 of each compartment.

The compartment size of the bottom wall surface was set as 500 to 600 mm square because this size allows an operator present on the bottom wall surface of other compartments to reach (conduct maintenance of) all hoppers when the grating and/or the metal mesh covering the bottom wall surface of one compartment are removed.

In addition, when, for example, the rails for a cart on which the workpiece W is disposed are to be extended onto the bottom wall surface 20 of the blasting chamber 2 formed in the cabinet 3, the rails can be drawn out easily even from the outside of the cabinet 3 by removing the grating 21 and, as required, the metal mesh 22 at a portion necessary for drawing out the rails and then fitting the grating 21 having the rails mounted thereon and members forming the bottom wall surface into this portion.

By covering the top openings of the hoppers 10 with perforated plates, such as the metal mesh 22 and/or the grating 21, to form the bottom wall surface 20 as described above, the abrasive ejected onto the workpiece W disposed on the bottom wall surface at any position in this blasting chamber 2, dust generated by ejecting such abrasive, and so forth can be recovered into the hoppers 10 (in each hopper 10) through the openings formed in the grating 21 and/or the metal mesh 22 constituting the bottom wall surface 20.

Moreover, the air in the recovery pipes 30 communicating with the bottom 14 of each hopper 10 is sucked by, for example, the blower provided in the dust collector. Thus, the abrasive that has been recovered by each hopper 10 and has fallen into the recovery pipes 30 through the apertures 15 is sucked due to negative pressure in the recovery pipes and is transported along with the air in the recovery pipes. Thereafter, the abrasive is introduced into the cyclone (not shown in the figure) for recovering the abrasive to recover the reusable abrasive. Subsequently, dust resulting from filtering the reusable abrasive in the cyclone is introduced into, for example, the dust collector (not shown in the figure), the dust in a mixed gas composed of dust and air is removed, and then only refined air is discharged outside the machine.

In the structure according to this embodiment in which the recovery pipes 30 that are rectangular in cross-section are made to communicate with sets of two columns of the hoppers 10, as described above, the introduction of the abrasive into the recovery pipes 30 is carried out at both sides in the width direction of the recovery pipes 30, as shown in FIG. 4A. Therefore, even if some abrasives that have fallen into the recovery pipes 30 is not recovered but remains in the recovery pipes 30 due to, for example, temporary failure in sucking the air in the recovery pipes 30, only a small amount of the abrasive falls into the recovery pipes 30 at a time through the small apertures 15 formed at the bottom surface 14 of each hopper 10. In this manner, the recovery pipes 30 can be prevented from being clogged by the abrasive in a short period of time. In addition, a relatively large space that can serve as an air passage is formed near the center in the width direction of the recovery pipes 30.

For this reason, with a structure where the recovery pipes 30 are rectangular in cross section as described above, clogging can be prevented from occurring even if the interior atmosphere of the recovery pipes 30 is not sucked constantly but sucked only intermittently. Suction may be carried out sequentially at time intervals in predetermined groups, such as in groups of the recovery pipes 30 of each unit or in a predetermined number of recovery pipes 30, for example, by providing switching means, such as a switching valve, in the connection pipe 40 joining each one end of a group of the recovery pipes 30.

If a structure in which suction of atmosphere is sequentially carried out at time intervals for each recovery pipe 30 or for a predetermined number of recovery pipes 30, as described above, is adopted, the sizes of the dust collector (the blower provided in the dust collector) required for suction, the cyclone, the duct, and so forth can be reduced, compared with a case where of atmosphere in all recovery pipes 30 is sucked at the same time, thereby reducing the size of the overall machine.

Amount of Wind in Recovery Pipe

When wind with a velocity of, for example, 15 m/min is made to flow in a 10 cm×20 cm square pipe, the amount of wind (the amount of air passing through the cross-section of the recovery pipe) per minute is given by the expression below.

$$0.1\times0.2\times15\times60=18\ m^3/min$$

If this recovery pipe is to be sucked, for example, 6(Six) pipes at the same time, the amount of air that is sucked by the blower per minute are calculated as 108 $m^3$/min, which is a large amount of wind.

If this suction is carried out for three recovery pipes at a time, that is, two of these suction sessions are carried out for 6(Six) recovery pipes, the amount of suction air in the blower per minute is half the above-described amount of wind, that is, 54 $m^3$/min. If suction is carried out for two recovery pipes at a time, that is, three suction sessions for 6(Six) recovery pipes, the amount of suction air is reduced to one-third, i.e., 36 $m^3$/min.

Since 10 to 20 or more recovery pipes may be prepared for a large blasting machine, a much larger amount of wind is required to suck all these recovery pipes simultaneously. Even in this case, the dust collector (blower) to be used, the cyclone, the duct, and so forth can be made compact by providing the above-described structure in which no clogging occurs in the recovery pipes even if an intermittent suction approach is adopted and by allowing a predetermined number of recovery pipes to be sequentially sucked at a time.

If the number of the recovery pipes 30 that are sucked simultaneously is set as a prescribed value, the amount of suction required for, for example, the dust collector does not vary. Thus, even if the number of hoppers disposed below the bottom wall surface is increased, the blower used for suction, the cyclone, the duct, and so forth can be shared, thereby reducing a manufacturing cost of the machine.

The bottom 14 of each hopper 10 is relatively small in width. Therefore, only an extremely small amount of the abrasive fails to fall and remains in the hoppers 10 (so-called "dead sand"), and furthermore, for the abrasive that has fallen into the recovery pipes 30, the recovery pipes 30 that are rectangular in cross-section with superior recovery efficiency are used to achieve a wind velocity of 15 m/s or more. As a result, while suction of atmosphere in the recovery pipes 30 is being carried out, the abrasive in the recovery pipes 30 is recovered in the recovery tank in a short period of time through, for example, the cyclone for recycling.

For this reason, in general, in order to recycle the abrasive, some extra abrasives need to be circulated, allowing for the amount of the abrasive residing in the machine. Because of this, although the amount of the abrasive to be used increases, it is possible to reduce the amount of the abrasive to be used since only an extremely small amount of the abrasive resides in the blasting machine 1 including the bottom wall structure according to the present invention.

The above-described structure has been described assuming that a unit having the hoppers 10 formed on the entire surface below the bottom wall surface 20 of the blasting chamber 2 is disposed. However, the unit having the above-described hoppers 10 formed therein may be disposed only at a part of the area serving as the bottom wall surface 20 of the blasting chamber 2, for example, at one end, at both ends, or in the center along the width direction, so that the abrasive can be recovered through this part. In this case, the other part of the bottom wall surface 20 of the blasting chamber 2 is covered by, for example, a metal plate having no aperture.

Stopper Pipe

Figure 8:
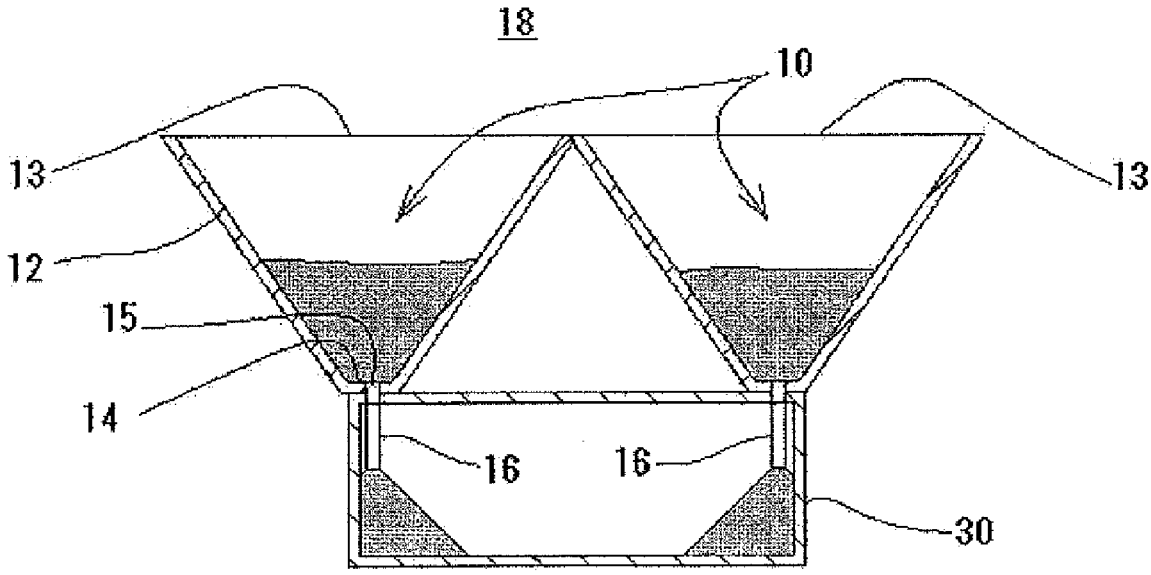
FIG. 8 is a cross-sectional view of a recovery unit including pipes, serving as stoppers, extending from a set of two columns of hoppers to a recovery pipe.

For communication between the above-described hoppers 10 and the recovery pipes 30 disposed below the hoppers 10, a structure has been described such that the abrasive falls into the recovery pipes 30 through the apertures 15 formed so as to pass through both the bottoms 14 of the hoppers 10 and the top surfaces of the recovery pipes 30. As shown in FIG. 8, however, it is preferable to provide pipes 16 whose top ends are made to communicate with the above-described apertures 15 passing through the bottoms 14 of the hoppers 10 and the top surfaces of the recovery pipes 30 and whose bottom ends protrude by a predetermined distance from the bottom surfaces of the above-described recovery pipes 30.

If suction of atmosphere is sequentially carried out for each recovery pipe 30 or for each predetermined number of recovery pipes 30 as described above, a period of time during which no suction of atmosphere is carried out occurs in the recovery pipes 30. During this no-suction period, the abrasive falling from the hoppers 10 into the recovery pipes 30 is accumulated in these recovery pipes 30.

However, due to these pipes 16 provided as described above, when the abrasive accumulated in the recovery pipes 30 reaches the bottom-end positions of the pipes 16, the bottom ends of the pipes 16 are blocked by the accumulated abrasive. In this manner, any abrasive in the hoppers 10 is prevented from falling into the recovery pipes 30 and continues to remain in each hopper 10. Therefore, the excessive abrasive is prevented from being introduced into the recovery pipes 30, thereby making it difficult for clogging to occur.

Even though the abrasive is accumulated in a recovery pipe 30, the accumulated abrasive can be prevented from clogging the recovery pipe 30 and can be successfully recovered if a space of about 60% is secured in the recovery pipe. For this purpose, the pipe protrusion length, tube diameter, and so forth are adjusted taking into consideration the angle of repose of the abrasive to be used based on the type of the abrasive, grain size, and so forth so that the abrasive does not occupy 40% or more of the space in the recovery pipe.

It is preferable that these pipes 16 have an inner diameter of as small as about 10 to 20 mm to prevent a large amount of the abrasive from falling all at once.

Furthermore, as with the above-described apertures 15, the inner diameters need to be set so that no excessive amount of air flows in the apertures 15 from the hoppers 10.

Table 3 lists one example of the sizes of the recovery pipes 30 to be used, the inner diameters of the pipes 16 corresponding to each recovery pipe 30, and the amount of the abrasive falling through these pipes 16, which were discovered by the inventors through experiments.

TABLE 3

One example of size of recovery pipe, inner diameter of extension pipe corresponding thereto, and amount of abrasives falling down.

| Size of recovery pipe | Inner diameter of extension pipe | Amount of spontaneous falling abrasive (alundum) |
|---|---|---|
| 250 × 100 mm (equivalent to ϕ180) | 12 mm | 3 kg/min |
| 320 × 115 mm (equivalent to ϕ216) | 13 mm | 3.5 kg/min |
| 400 × 140 mm (equivalent to ϕ267) | 14 mm | 4 kg/min |
| 500 × 160 mm (equivalent to ϕ318) | 16 mm | 5.2 kg/min |

The protrusion length at the bottom end of each pipe 16 (distance from the pipe 16 to the recovery pipe bottom surface) is set such that the pipe 16 terminates at a space in the recovery pipes 30 (to provide a gap between the pipe 16 and the bottom) as described above. This is advantageous in that an excessive amount of the abrasive in the hoppers 10 is prevented from falling while no suction of atmosphere is carried out in the recovery pipes 30 as described above. On the other hand, while suction of atmosphere is being carried out in the recovery pipes 30, turbulence occurring in the recovery pipe due to the above-described pipe 16 makes it possible for the abrasive to be blown more easily.

In order to efficiently recover the abrasive, the abrasive needs to be subjected to lateral air flow while it is falling towards the recovery pipes 30 to redirect the flow of the abrasive in the horizontal direction before the abrasive reaches the bottom surface of the recovery pipes 30, thus spreading out the abrasive. If this approach is not adopted, the abrasive temporarily resides on the bottom surface of the recovery pipe and cannot be moved without velocity energy. In particular, an air velocity about twice the wind velocity described in the subsequent paragraph may be required to blow away a dense abrasive.

For a height of 50 to 100 mm, a wind velocity of 12 to 25 m/s is normally required to blow, for example, about A#60 abrasive by horizontal wind. It is preferable that the protrusion lengths of the above-described pipes 16 be set such that the falling of the abrasive is stopped before the recovery pipes 30 become clogged and that the abrasive can be blown by the flow in the recovery pipes 30 while suction of atmosphere is being carried out in the recovery pipes 30.

Air Introduction Pipe

It is also preferable that air introduction conduits 31 introducing external air into these recovery pipes 30 are provided in the above-described recovery pipes 30, preferably at predetermined intervals in the length direction, to eliminate any abrasive clogging the recovery pipes 30.

While the recovery pipes 30 are functioning normally without clogging, these introduction conduits 31 are closed by caps 32, that is, external air is not introduced through these introduction conduits 31. Only when the recovery pipes 30 are clogged with, for example, the abrasive, the introduction conduits 31 are opened to introduce external air therethrough into the recovery pipes 30.

Figure 9A:
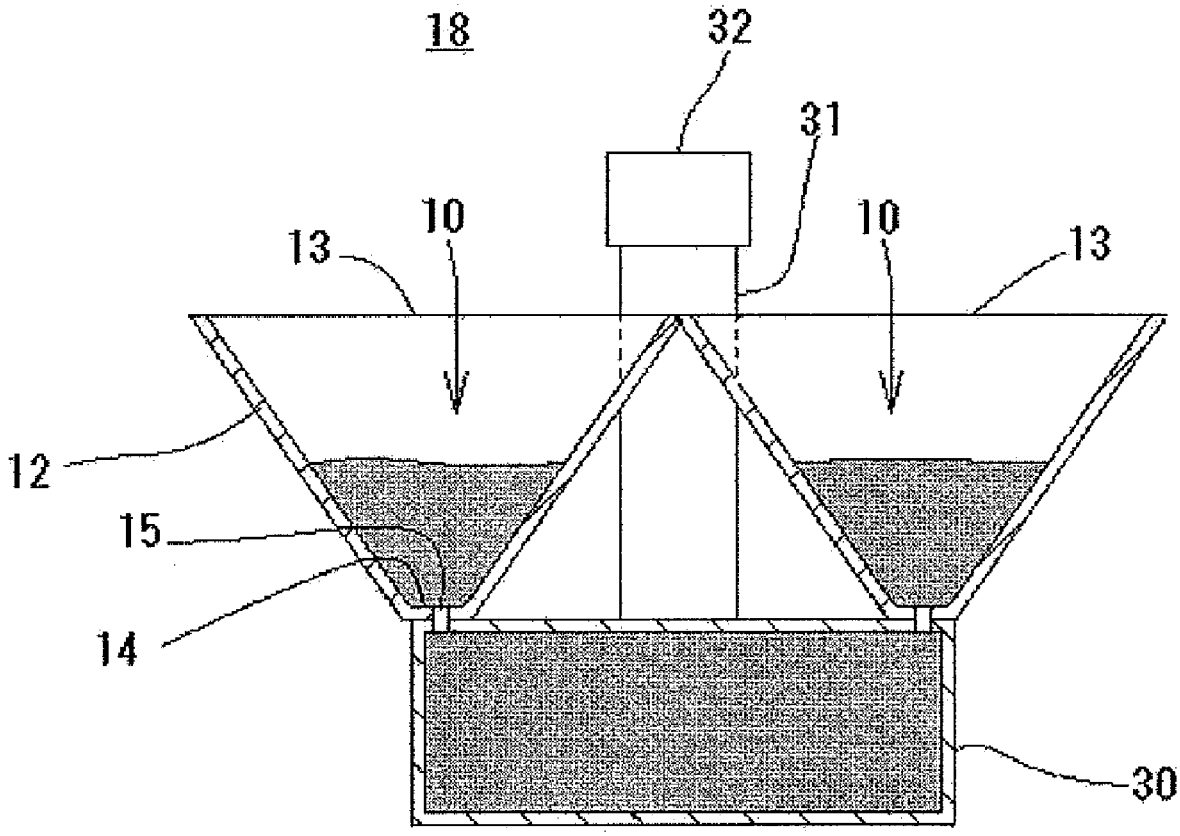
Figure 9B:
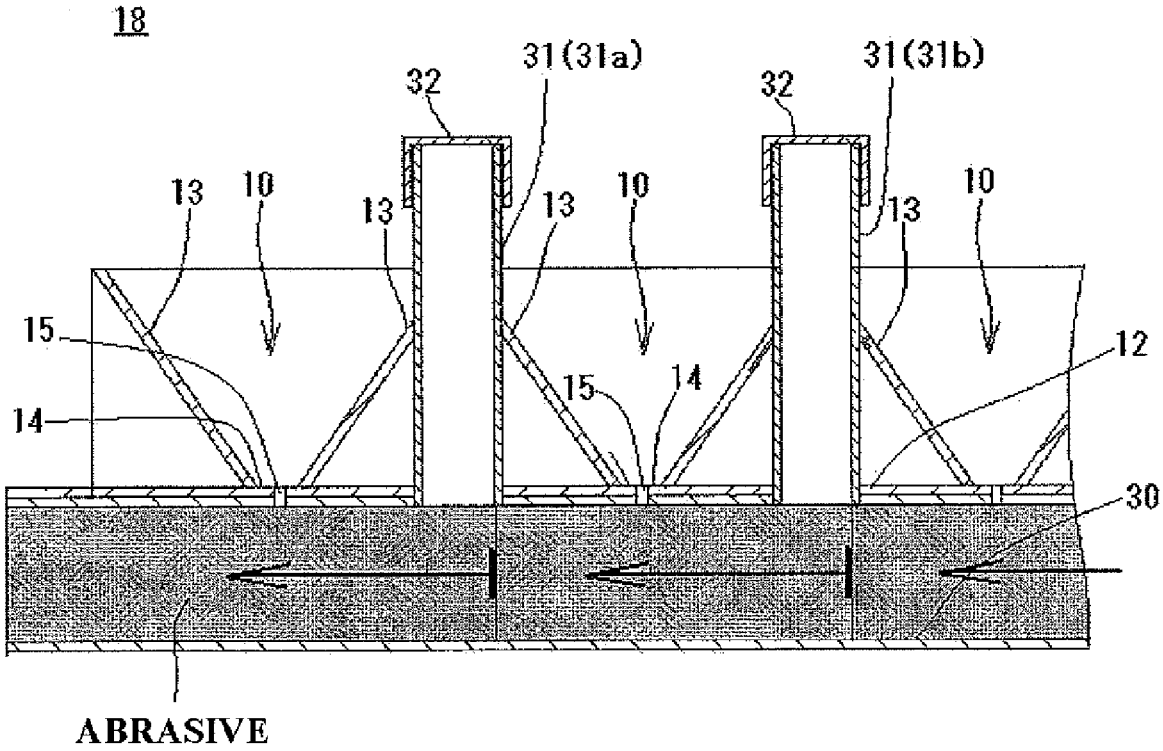

An introduction conduit 31 is preferably arranged between every two adjacent hoppers 10 formed in the length direction of the recovery pipes 30. Referring to FIGS. 9A and 9B, the introduction conduits 31 are utilized, for example, in a case where the abrasive in the recovery pipes 30 cannot be recovered by suction of, for example, the blower as a result of continuous clogging of the abrasive occurring in the length direction in the recovery pipes 30.

If such clogging extends beyond the recovery pipes 30 to the connection pipe 40 joining these recovery pipes 30, a part of the conduit may need to be removed to expose a linkage end, from which the abrasive in the connection pipe 40 can be discharged to make the connection pipe 40 emptied.

Thereafter, the cap 32 closing the introduction conduit closest to the blower (e.g., 31*a*) from among the above-described introduction conduits 31 provided in the recovery pipes 30 is removed to open the introduction conduit. The interior atmosphere of these recovery pipes 30 are sucked using the blower. Of the abrasive clogging the recovery pipes 30, such abrasive downstream of this opened introduction conduit 31*a* is recovered first.

When the abrasive downstream of the introduction conduit 31*a* closest to the blower has been recovered as described above, this opened introduction conduit 31*a* is closed again with the cap. Subsequently, the cap 32 for an introduction conduit 31*b* adjacent to the above-described introduction conduit, i.e., the introduction conduit upstream from the introduction conduit 31*a*, is opened. Then, the interior atmosphere of the recovery pipes is sucked using the above-described blower. By repeating this procedure, all matter, including the abrasive, clogging the recovery pipes 30 can be recovered to eliminate clogging.

Reinforcing Member

Portions, such as the bottom surfaces, in the recovery pipes 30 that will be in contact with the abrasive can be reinforced by inserting a sheet-shaped reinforcing member in the length direction of the recovery pipes 30 to cover such portions that will be in contact with the abrasive. Furthermore, any hole formed in the recovery pipes 30 due to wear by the abrasive may be repaired.

Thus the broadest claims that follow are not directed to a machine that is configured in a specific way. Instead, said broadest claims are intended to protect the heart or essence of this breakthrough invention. This invention is clearly new and useful. Moreover, it was not obvious to those of ordinary skill in the art at the time it was made, in view of the prior art when considered as a whole.

Moreover, in view of the revolutionary nature of this invention, it is clearly a pioneering invention. As such, the claims that follow are entitled to very broad interpretation so as to protect the heart of this invention, as a matter of law.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described;

What is claimed is:

1. An abrasive-recovery mechanism in a blasting machine, comprising:

a cabinet in the blasting machine;

a mesh member dividing the cabinet into an upper space and a lower space, the mesh member capable of letting an abrasive pass therethrough;

a blasting chamber having a bottom wall surface defined by the mesh member; and a set of two columns of a plurality of hoppers formed by disposing dividing plates each of which is substantially shaped like an inverted triangle in two parallel groves composing a gutter that is substantially W-shaped in cross-section to define and divide a space in each of the two parallel grooves into an inverted quadrangular pyramid, the plurality of hoppers being disposed below the mesh member, wherein top portions of the plurality of hoppers are opened toward the mesh member, the set of two columns of the plurality of hoppers formed in the gutter and a recovery pipe that is attached to the gutter and communicates with the bottom end of each of the plurality of hoppers constitute a recovery unit such that a direction in which the plurality of hoppers are arranged is defined as a length direction, and at least one of the recovery units is disposed below the mesh member, the recovery pipe is a rectangle in cross-section, and the bottom end of each of the plurality of hoppers communicate with suction means through a recovery pipe at either rend of the long side of the cross-section.

2. The abrasive-recovery mechanism in a blasting machine according to claim 1, wherein a ratio of a long side of the recovery pipe to a short side of the recovery pipe is at least 1.5.

3. The abrasive-recovery mechanism in a blasting machine according to claim 1, further comprising a pipe for extending an aperture communicating between each of the plurality of hoppers and the recovery pipe, wherein a protrusion length at a bottom end of the pipe is set such that the pipe terminates at a space in the recovery pipe.

4. The abrasive-recovery mechanism in a blasting machine according to claim 1, further comprising a plurality of air introduction pipes for introducing external air into the recovery pipe, the plurality of air introduction pipes being arranged at regular intervals along the length direction of the recovery pipe.

5. The abrasive-recovery mechanism in a blasting machine according to claim 1, further comprising a plurality of air introduction pipes for introducing external air into the recovery pipe, the plurality of air introduction pipes being arranged at regular intervals along the length direction of the recovery pipe.

6. The abrasive-recovery mechanism in a blasting machine according to claim 1, further comprising a plurality of air introduction pipes for introducing external air into the recovery pipe, the plurality of air introduction pipes being arranged at regular intervals along the length direction of the recovery pipe.

7. The abrasive-recovery mechanism in a blasting machine according to claim 3, further comprising a plurality of air introduction pipes for introducing external air into the recovery pipe, the plurality of air introduction pipes being arranged at regular intervals along the length direction of the recovery pipe.

8. The abrasive-recovery mechanism in a blasting machine according to claim 1, further comprising switching means for sequentially connecting the recovery pipe to the suction means, for the recovery pipe of each recovery unit or the recovery pipes of a predetermined number of recovery units.

9. The abrasive-recovery mechanism in a blasting machine according to claim 1, further comprising switching means for sequentially connecting the recovery pipe to the suction means, for the recovery pipe of each recovery unit or the recovery pipes of a predetermined number of recovery units.

10. The abrasive-recovery mechanism in a blasting machine according to claim 3, further comprising switching means for sequentially connecting the recovery pipe to the suction means, for the recovery pipe of each recovery unit or the recovery pipes of a predetermined number of recovery units.

* * * * *